US006851159B1

(12) United States Patent
Nikolic et al.

(10) Patent No.: US 6,851,159 B1
(45) Date of Patent: Feb. 8, 2005

(54) DOOR HINGE

(75) Inventors: Zeljko Nikolic, Remscheid (DE); Georg Dell, Remscheid (DE); Richard Morawetz, Wuppertal (DE)

(73) Assignee: Edscha AG, Remscheid (DE)

( * ) Notice: Subject to any disclaimer, the term of this patent is extended or adjusted under 35 U.S.C. 154(b) by 0 days.

(21) Appl. No.: 10/110,566

(22) PCT Filed: Oct. 7, 2000

(86) PCT No.: PCT/DE00/03555

§ 371 (c)(1),
(2), (4) Date: Jul. 29, 2002

(87) PCT Pub. No.: WO01/27424

PCT Pub. Date: Apr. 19, 2001

(30) Foreign Application Priority Data

Oct. 14, 1999 (DE) ..... 199 49 647

(51) Int. Cl.[7] ..... E05D 11/10
(52) U.S. Cl. ..... 16/335; 16/308
(58) Field of Search ..... 16/335, 392, 308, 16/354, 352; 296/146.11

(56) References Cited

U.S. PATENT DOCUMENTS

| | | | | | |
|---|---|---|---|---|---|
| 3,065,497 | A | * | 11/1962 | Faber | 16/142 |
| 3,370,317 | A | * | 2/1968 | Marchione | 16/308 |
| 3,820,192 | A | * | 6/1974 | Nakano et al. | 16/334 |
| 3,911,529 | A | * | 10/1975 | Pringle | 16/335 |
| 3,931,664 | A | * | 1/1976 | Nakano et al. | 16/296 |
| 4,266,321 | A | * | 5/1981 | Pelchat et al. | 16/335 |
| 4,332,055 | A | | 6/1982 | Rudnick et al. | 16/335 |
| 4,428,096 | A | * | 1/1984 | Kaspar | 16/335 |
| 4,536,918 | A | * | 8/1985 | Brockhaus | 16/308 |
| 4,738,003 | A | | 4/1988 | Mori et al. | 16/321 |
| 4,807,331 | A | * | 2/1989 | Calucci | 16/262 |
| 4,815,164 | A | * | 3/1989 | Rottinghaus | 16/296 |
| 4,864,687 | A | * | 9/1989 | Calcaterra et al. | 16/237 |
| 4,932,101 | A | * | 6/1990 | Lualdi | 16/255 |
| 5,018,243 | A | * | 5/1991 | Anspaugh et al. | 16/335 |
| 5,074,010 | A | * | 12/1991 | Gignac et al. | 16/334 |
| 5,226,202 | A | * | 7/1993 | Griffins | 16/264 |
| 5,235,726 | A | * | 8/1993 | Geier et al. | 16/334 |
| 5,524,324 | A | * | 6/1996 | Kunkel | 16/334 |
| 5,575,037 | A | * | 11/1996 | Tolle et al. | 16/334 |
| 5,675,869 | A | * | 10/1997 | Lotz | 16/334 |
| 5,791,017 | A | * | 8/1998 | Kluting | 16/334 |
| 5,794,309 | A | * | 8/1998 | Lotz | 16/334 |
| 5,850,673 | A | * | 12/1998 | Wood et al. | 16/334 |
| 6,125,508 | A | * | 10/2000 | Formenti | 16/335 |
| 6,549,859 | B1 | * | 4/2003 | Ward | 702/66 |
| 6,568,741 | B1 | * | 5/2003 | Leung et al. | 296/146.11 |

FOREIGN PATENT DOCUMENTS

| | | |
|---|---|---|
| DE | 1230328 | 12/1966 |
| DE | 2015147 | 10/1970 |
| DE | 3223938 | 12/1983 |
| DE | 68903867 | 10/1989 |
| DE | 19811108 | 2/1999 |
| EP | 0338348 | 10/1989 |
| GB | 2155540 | 9/1985 |

* cited by examiner

*Primary Examiner*—John B. Walsh
(74) *Attorney, Agent, or Firm*—Davidson, Davidson & Kappel, LLC

(57) ABSTRACT

The invention relates to a door hinge for a door of a vehicle. The inventive hinge comprises a first and a second guiding arrangement (7, 20; 7, 30, 31) for fixing at least one holding position for the door hinge. Said hinge also comprises a first and a seond free end (19) which engage with the first and second guiding arrangements. Said ends belong to a spring element (16). The aim of the invention is to provide a door hinge that is constructed in a compact manner and reliably enables to fix the door hinge, whereby moments crosswise in relation to the swivelling axis are prevented. To this end, the first free end (19) and the second free end (19) respectively are arranged in a mirror-inverted manner in relation to each other and at the remaining halve (3) of the hinge.

26 Claims, 4 Drawing Sheets

DOOR HINGE

BACKGROUND OF THE INVENTION

The invention relates to a door hinge for a vehicle door, comprising a first and a second hinge half, each of which can alternatively be fastened to one of the door assembly parts door and door pillar; a hinge pin which connects the first and the second hinge halves pivotably to each other; a first guiding arrangement which is formed on one of the first and second hinge halves and is intended for securing at least one holding position for the door hinge; a first free end of a spring element secured on the other of the first and second hinge halves, which free end interacts with the first guiding arrangement; a second guiding arrangement which is formed on the one hinge half and is intended for securing at least one holding position for the door hinge; and a second free end of a spring element secured on the other hinge half, which end interacts with the second guiding arrangement.

DE-A-32 23 938 describes a door-securing means which is combined with a hinge and has a torsion bar spring secured on one hinge half, both ends of which spring are provided with running rollers which roll against two differently configured curved sections of the other hinge half, the curved sections defining different latching positions by means of latching depressions and cams. The known door-securing means has a series of deficiencies which have an adverse effect on its practical use. For example, in order for the door-securing means to function, a first cam plate on the one side of the pivot axis has to be acted upon while the other cam plate on the opposite side with regard to the hinge axis, acts upon a cam plate. This is necessary since the torsion bar spring would otherwise not be stressed. This causes moments to act on the hinge as a whole transversely to the pivot axis because of the prestressing of the torsion bar spring, said moments leading to increased wear of the hinge pin and to noisy running characteristics. Since the one end of the torsion bar spring bears on the rear side against the corresponding cam plate, the first hinge half has to be arranged near to one end side of the vehicle door so that the end with the running roller provided on it can reach behind the stop surface of the first hinge half. This leads at the same time to a nonuniform deformation of the two ends of the torsion bar spring, the ends being of different lengths as a result and causing different loads on the curved paths. A further disadvantage resides in the fact that the cam plates of the other hinge half are essentially arranged centrally, as a result of which a corresponding opening has to be provided in the first hinge half in order to allow them to pass through there. Finally, the necessary forces require a large lever between the mounting of the spring and its ends, and therefore cause larger hinge halves than necessary.

EP-B-0 338 348 describes a door hinge which connects a first hinge half and a second hinge half pivotably to each other via a hinge pin, the first hinge half having an opening in which the two ends of a torsion bar spring are fixed. The torsion bar spring has a design similar to a large B, there being arranged on the spring element, opposite the two free ends, a running roller which is intended to come to bear against an extension, which is connected in a rotationally fixed manner to the second hinge half, in order to act upon said extension in the region of a cam path. In this case, the spring element is held on that side of the first hinge half which faces the door assembly part, and extends with the latching roller a good distance beyond the region of the first hinge half in order to come into engagement with the guiding arrangement. The forces transmitted to the guiding arrangement are only small and have unfavorable lever ratios. In particular, the first hinge half has to be arranged close to one edge of the door assembly part, and has to be configured to be comparatively large in size. Also, the second hinge half has merely one single guiding arrangement which defines corresponding latching positions.

DE-A-12 30 328 describes a door-securing means for a door hinge, in which a spring element comprising a torsion bar is secured via a flat wire clamp on a strut of a first door assembly part where it takes on the function of a first hinge half whereas there is a curved path on a hinge reinforcement of the other door assembly part, said curved path defining a section of the torsion wire of the guiding arrangement, which section is configured in the manner of a spring fork. Moments occur transversely with respect to the hinge axis because the door-securing means is arranged outside the actual door hinge. The flat wire clamps are configured in such a manner that they secure a first section of the torsion wire parallel to the spring fork and secure a second section of the torsion wire essentially parallel to the legs of the U-shaped spring fork after said torsion wire has been bent around three corners.

DE-A-198 11 108 describes a door hinge which connects two hinge halves in an articulated manner via a hinge pin and secures latching positions of the hinge halves with respect to one another via an S-shaped spring element by the free spring end thereof gripping a profiled guiding arrangement of one of the spring halves. The disadvantage in the case of the known door hinge is its large space requirement since the guiding arrangement, which can have a contour defining a number of latching marks, is to be arranged at a certain distance from the hinge pin defining the pivot axis of the hinge, in order to ensure reliable transmission of the spring forces to the guiding arrangement. This distance, which is defined by the spring force to be set, defines the installation depth of the hinge, which depth in turn limits the dimensions of the beam to which the pillar-side hinge half is to be fastened. In addition, the one-sided load because of the spring element causes moments acting transversely with respect to the pivot axis of the door hinge, as a result of which the door hinge has a tendency to tilt and thus to become jammed.

SUMMARY OF THE INVENTION

It is an object of the invention to provide a door hinge which reliably permits, with a compact construction, the door hinge to be secured while avoiding moments acting transversely with respect to the pivot axis.

The present invention provides that the first force end and the second free end are arranged in each case in a mirror-inverted manner with respect to each other on the other hinge half.

The door hinge according to the invention has a first guiding arrangement and a second guiding arrangement, a free end of a spring element secured on the other hinge half interacting with each of the two guiding arrangements and making it possible for the door hinge to be guided and secured by latching during opening and during closing. Consequently, spring forces are doubly transmitted to one guiding arrangement in each case and therefore to the one hinge half, and hence the provision of two free ends of spring elements which transmit the forces means that the holding forces of said spring elements need to be designed to be less strong in each case and it is therefore possible to provide the guiding arrangements at a smaller distance from the hinge pin. The door hinge according to the invention can therefore be configured to be small in structure, and can be advantageously used even when there is restricted installation space available, in particular with regard to the installation width which is available. It is obvious that in principle the distance of the first or second guiding arrangement from the hinge pin may be selected differently, but expediently the same distance is selected. According to the invention, the two spring elements are arranged in an essentially mirror-inverted manner on the other hinge half, with the result that they generate the same forces because of their stress, and mutually neutralize any laterally acting forces, in particular moments transversely with respect to the pivot axis of the two hinge halves.

The first and the second guiding arrangements are preferably designed in a mirror-inverted manner with respect to each other, at least with regard to a feature concerning the securing of the door hinge. This makes it possible in a simple manner to uniformly select for both guiding arrangements the same latching angle for the door to be fastened to the door hinge, the same forces with regard to the opening or closing of the door hinge or else the distance of the contour of the guiding arrangements from the hinge pin.

Nevertheless, other features which are not important for the securing of the door hinge can be designed such that they differ and are not mirror-inverted. It is therefore possible, for example, that the flat sides which do not grip the free ends of the spring elements have different surface structures in the region of the guiding arrangement.

The first free end and the second free end preferably belong to the same spring element which, unlike known door hinges having a spring element for securing purposes, is not secured to a free end in the other hinge half, but approximately in its central region. By this means, it is ensured, by means of the single-piece design of the spring element and therefore the uniform selection of the material, that the prestresses acting on the two ends are essentially the same size. The two legs of the spring element which connect the two free ends to the central region are expediently designed to be of the same length.

Each free end of the spring element is expediently prestressed by a sleeve being arranged, for example, in the region of the leg in the other hinge half, which sleeve supports said leg and is arranged in a position which is raised with respect to the plane formed by the central region and the free end and therefore ensures prestressing of the free end. The prestress required for securing a motor vehicle door can advantageously be obtained thereby, in which case the two free ends remain on the same side of a hinge half.

The central region of the spring element is expediently held in a clamping manner in a clamping unit in the other hinge half and, in particular, is prevented from shifting in the direction of the holder of the legs in the sleeves. The central region, which is grasped in the clamping unit, and that section of the leg which is guided in the sleeve are expediently orientated essentially parallel to each other in order to secure rotational locking about the section of the leg in the sleeve, in which case it is furthermore preferably also for the free end of the spring element to again run parallel to the two abovementioned parts. However, it is not a problem if a deviation from the parallelism of a few degrees has to be taken into consideration because of the prestressing of the spring element and the fixing to the respective hinge halves. For the case in which the two free ends belong to two spring elements, it is possible to hold the respective other end thereof in a common clamping unit or adjacently in clamping units of the other hinge half. The clamping unit can then also be designed as a blind hole or the like. However, the advantage of the single-piece design of the spring element is that axial slipping is avoided by an expedient determination of the held or guided sections of the spring element and the bearing of the free ends against the guiding arrangement is ensured.

Preferably, the two legs of the spring element essentially have together the contour of three leaves of a three-leaf clover leaf, it being possible also to explain this contour as an implied, outlined T. The two free ends of the spring element, i.e. its end surfaces, face each other. The free ends are at a small distance from the hinge pin, and therefore enable a compact construction of the door hinge.

It is possible in principle for the first and the second guiding arrangements in each case to define different latching positions for the door hinge, with the result that each of the first and second guiding arrangements defines by itself one latching position in each case for the door hinge, in which case a relatively high latching force has to be overcome if both guiding arrangements define the same latching position and a relatively small latching force has to be overcome if only one of the two guiding arrangements defines a latching position. However, it is preferred for both guiding arrangements to select the same latching positions because the door hinge is uniformly loaded thereby and the tilting tendency is thereby reduced.

In addition to the latching positions which are preset by the guiding arrangements, the maximum opening angle can advantageously be defined by a stop on account of projections of the hinge halves which strike against each other when the preset, maximum opening angle is reached. It is likewise possible, for safety reasons, to likewise provide a mutual striking of the hinge halves for the closing position. The stops, which mutually lock the hinge halves mechanically, can advantageously be combined with one another by latching positions of the guiding arrangements close to the end position in such a manner that the door is held fixedly in its maximum opening angle of, for example, 70°.

According to a first preferred development of the door hinge according to the invention, at least one, and preferably both, of the first and second guiding arrangements is/are designed as a latching arrangement which has at least one latching roller which defines a latching holding position for that free end of the spring element which is assigned to the at least one guiding arrangement. The latching rollers are mounted about a rotational axis on the outwardly directed flat side which extends essentially parallel to the profile of the free end of the spring element and the circumference of which is, together with projections, non-circular in terms of circumference. Recesses are provided in the projections of the latching rollers, the radius of which recesses corresponds essentially to the circumferential radius of the free end of the spring element such that the latching rollers are entrained by the free end when it passes by. Each latching roller preferably defines a latching position, so that the number of the latching rollers essentially corresponds to the number of latching positions. The design of the guiding arrangement as the latching arrangement with latching rollers has the advantage that high forces to be overcome can thereby be set in a simple manner, and also the wear of the free end of the spring element is low on account of the entrained guide. Furthermore, it is particularly simple with latching rollers to hold the two spring elements in different latching positions.

According to a second preferred development of the door hinge according to the invention, at least one, and preferably both, of the first and second guiding arrangements has a profiled contour which has at least one depression which defines a latching position for that end of the spring element which is assigned to the at least one guiding arrangement. The contour which is formed in a narrow side of the one hinge half is therefore a guide for the free end of the assigned spring element. According to this preferred development, it is possible, in particular, only to form one of the two guiding arrangements in a profiled manner and to permit the latter, having the spring element assigned to it, to apply the holding forces, while the other guiding arrangement, having the spring element assigned to it, has a nonprofiled contour over which the free end can slide without changes in the prestress of the spring element. This variant is particularly preferred if, simultaneously with a latching position based on the first-mentioned, profiled contour, a change in the actuating force, which is required in order to move the door hinge, is to be set, for example by a progressive configuration of the contour not designed with depressions. Since the holding forces are composed in a first approach additively from the holding forces of the two spring elements, it is possible, by the combination of two different guiding arrangements or, preferably, by two identical guiding arrangements having an identical, profiled contour, for a resultant force to be set by which the hinge halves are mutually secured.

The free end of the spring element expediently has a running roller which is arranged rotatably on the free end and which can roll against the profiled contour, for example, and is prestressed against the guiding arrangement because of the prestress of the spring element. The running roller is, for example, a sintered material which can also be oil-impregnated in order to reduce the susceptibility to wear.

It is obvious that the combination of the two preferred developments of the door hinge according to the invention in a door hinge is, in principle, also possible.

According to a particularly preferred feature of the invention, the profiled contour of the guiding arrangement can be formed by an insert part which is inserted into the one hinge half. In this case, the insert part can be held fixedly in the one hinge half by bonding, welding, soldering or preferably by form-fitting clamping, any type of form-fitting or frictional connection being suitable in principle for the connection. The provision of an insert part to be fitted together with the hinge half advantageously opens up a way of hardening, for example by induction hardening, this contour, which is subject to particular stress because of the prestress of the spring element, irrespective of the hinge half which receives the insert part, the volumes and weights which are to be handled of the insert part being significantly smaller in comparison with the overall hinge half and therefore causing fewer costs. In addition to the profiling for the interaction with the free end of the spring element, the insert part preferably also has a further profiling which is designed such that it fits together with a corresponding mating profiling of the hinge half, with the result that the two parts mentioned can be plugged together or calked without using a great force in the manner of a plug and plug-in sleeve. It can be seen that not only is the machining process for the hardening of the contour thereby restricted only to the insert part, but that a standardized hinge half can be used the latching positions of which can be provided by an interchangeable contour in the insert part, depending on requirements in each case. The hinge half can therefore be realized, for example, as a sheet-metal part or as a part which is produced in an inexpensive mass production process, while the insert part is selected from a material of higher quality for the contact with the spring element and is profiled in accordance with the desired latching positions. For the configuration with two guiding arrangements, in particular, the provision of insert parts is also a significant advantage in terms of cost in comparison with the machining and induction hardening of the one hinge half itself. It is obvious that when an insert part is provided, surface hardening in the form of a coating, for example with TiN or TiC, is also possible, which coating would be extremely costly for the entire hinge half. Also, insert parts, which are relied on very particularly for the functioning of the door hinge, can be checked with regard to their quality substantially more easily. It is also possible, when the guiding arrangement is provided by means of the insert part, to further reduce the structural space required for the door hinge because minimum dimensions which are otherwise required for the machining of the hinge half do not have to be kept to and are not taken into consideration in an insert part inserted subsequently.

Each of the two hinge halves preferably has two end joints or gudgeons which are in each case connected in an articulated manner to one another by a hinge pin or alternatively by two hinge-pin stubs, the two joints of the one hinge half being arranged between those of the other hinge half, as a result of which symmetrical moments can be set again.

BRIEF DESCRIPTION OF THE DRAWINGS

Further advantages and features emerge from the following description and from the dependent claims.

The invention will be explained in greater detail below using preferred exemplary embodiments of a door hinge according to the invention and by reference to the attached drawings.

DETAILED DESCRIPTION OF THE INVENTION

Figure 1:
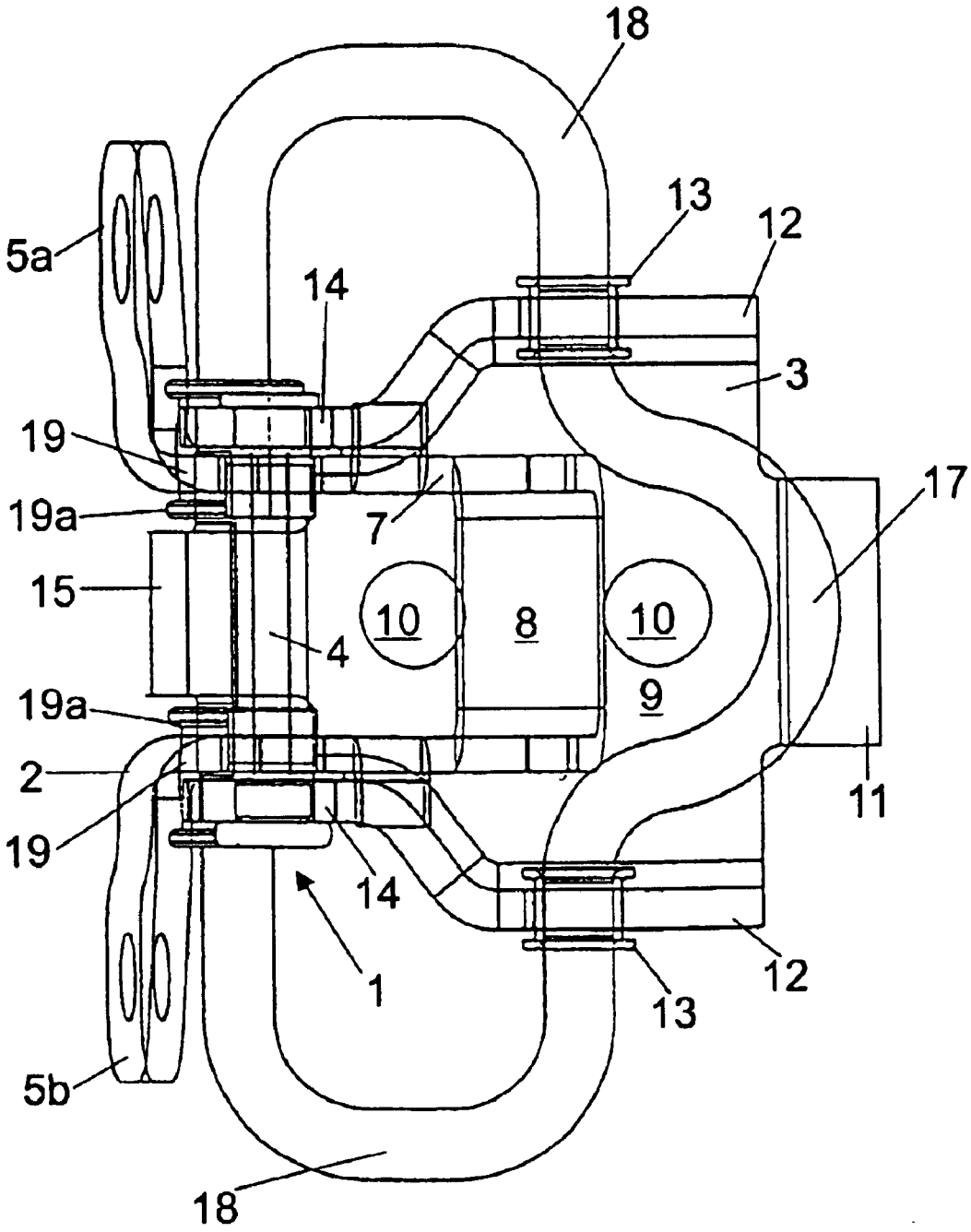
FIG. 1 shows a side view of a first preferred exemplary embodiment of a door hinge according to the invention with a view of the first, pillar-side door hinge.
Figure 3:
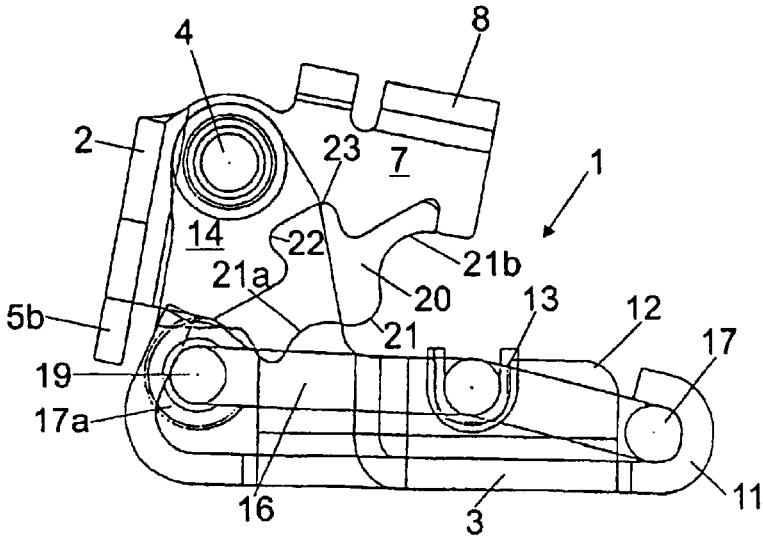
FIG. 3 shows an end view of the door hinge from FIGS. 1 and 2.
Figure 2:
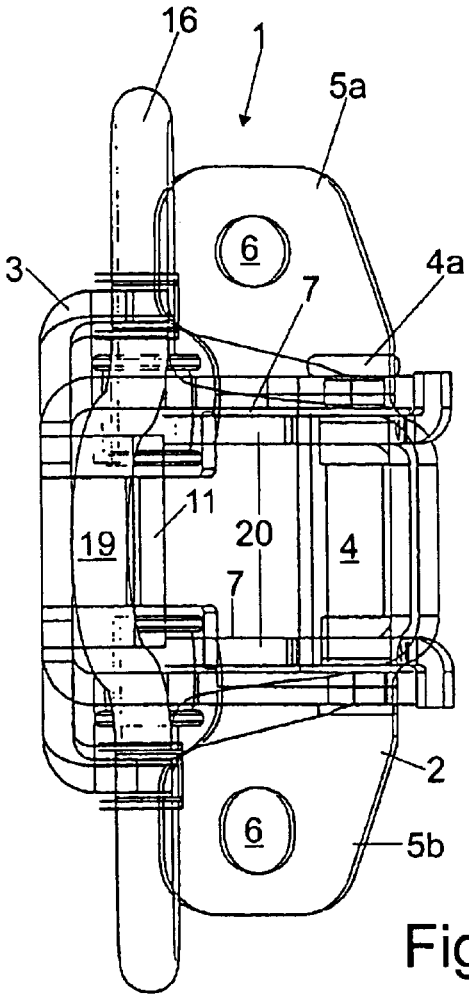
FIG. 2 shows a side view of the door hinge from FIG. 1 with a view of the second, door-side hinge half.

The door hinge 1 shown in FIG. 1 to 3 comprises a first hinge half 2, which is to be fastened to a door pillar of a vehicle body, and a second hinge half 3, which is to be fastened to the door of a vehicle, the first hinge half 2 and the second hinge half 3 being connected to each other via a hinge pin 4 which is held fixedly on the second hinge half 3 and rotatably on the first hinge half 2 with a running fit in the respectively assigned end joints. It can be seen that the two hinge halves 2, 3 in each case have two end joints designed for the pinning together, the hinge pin 4 being designed with a head 4*a* which forms a stop at one end and at its other end is secured in a known manner by riveting.

The first hinge half 2 has fastening tabs 5*a*, 5*b* which are directed outward on both sides, in each case have a hole 6 passing through them and are intended for the fastening of the hinge half 2 to the door pillar of a motor vehicle body.

The end-joint region in each case with a gudgeon of the first hinge half projects respectively at right angles from the two fastening tabs 5 and is adjoined in each case by a protruding extension 7, the two extensions being connected to each other via a crosspiece 8 which is bent off at right angles from them. The crosspiece 8 is, for example, welded together in its center from two bent-off sections of the extension 7. The first hinge half is of essentially mirror-symmetrical design, and for this reason individual identification in each case of the first and the second of the two mirror-symmetrical parts is omitted below.

The second hinge half 3 has a flat fastening part 9 for fastening to the door, which fastening part has two holes 10 passing through it. The fastening part 9 is bent over through approximately 200° at its end edge which faces away from the hinge pin 4 where it defines an (upwardly closed) clamping unit 11. At the two edges of the stop part 9 which are arranged perpendicularly with respect to the edge of the clamping unit 11, the edge is likewise bent over, but only by approximately 90°, the bent-over sections 12 having a passage in which a U-shaped sleeve 13 is inserted, the extension of the two bent-over sections 12 continuing as the end joints 14 of the second hinge half 3, which engage in each case around the outside of the end-joint surfaces of the first hinge half 2. A narrow bent-over section 15 which is formed on the edge lying opposite the clamping unit 11 has a smaller width than the distance of the two mutually facing surfaces of the extensions 7, and can in principle be pivoted through the latter.

A spring element which is designed as a torsion spring 16 is held in a clamping manner by its central region 17 in the clamping unit 11 of the second hinge half 3, the torsion spring 16, as can readily be seen in particular in FIG. 1, having the form of a three-leaf clover leaf or an implied T. The two legs 18 which emanate from the central region 17 are held raised with respect to the central region 17 in the sleeves 13, that region of the legs 18 which is held in the sleeve 13 and the tangent of the central region 17 of the torsion spring 16 being arranged essentially parallel to each other. That region of the legs 18 which projects outward from the second hinge half 3 is of essentially U-shaped design, the end sides of the first and second free ends 19 of the torsion spring 16 being arranged facing each other in the region of the extensions 7 of the first hinge half 2. As can be seen in particular in FIG. 3, the sleeves 13 for the two legs 18 define a direction of force which emanates from the plane formed by the central region 17 and the free ends 19 of the torsion spring 16 and therefore prestresses the free ends in the direction of the first hinge half 2. In the case of the door hinge 1, the free ends 19 of the torsion spring 16 in each case have a running roller 19*a* which is placed onto them and is designed with a respectively projecting collar on its end regions, between which collars a groove is defined which defines the actual running surface of the running roller 19*a*.

In the case of the door hinge 1, an insert part 20 is clamped in each case in the extension 7 of the first hinge half 2 by calking, the insert part 20 and the extension 7 essentially having the same thickness, with the result that the narrow side which faces the torsion spring 16 defines a first or a second guiding arrangement for one of the free ends 19 in each case of the torsion spring 16. In the present exemplary embodiment, in the case of the closed installation position which is illustrated in FIG. 3, the running roller 19*a* is initially supported in the impact region of the extension 7 and the insert part 20 in which case, by pivoting, the running roller 19*a* retraces the path defined by the profiling 21 of the insert part 20, and the torsion spring 16 is stressed or relaxed in accordance with the projections and the offsets, a residual stress always remaining. In a first latching position 21*a* the door hinge 1 is thereby securely locked while a second latching position 21*b* is defined near to the end stop, and a second latching position is defined shortly before the transition from the profiling 21 of the insert part 20 to the extension 7. In addition to the profiling 21 which is directed outward on the narrow side of the insert part 20, the insert part 20 has a holding profiling 22 which is directed toward the extension 7 and can be pressed into a mating profiling 23 of the insert part 7. It can be seen that undercuts in the mating profiling 23 enable calking of the holding profiling 22 of the insert part 20 in the extension 7 of the first hinge half 2. It can also be seen that by interchanging the insert part 20 with another insert part having a different profiling 21 the latching characteristics of the door hinge 1 can be changed in a simple manner.

During pivoting of the two hinge halves 2, 3 relative to each other the door hinge 1 is held in specified opening positions by the free ends 19 of the torsion spring 16 being latched in each case into the latching positions 21*a*, 21*b*, in which case it should be noted that the installation space taken up by the door hinge 1 is exceedingly small, since the distance of the fastening surface of the second hinge half 3 from the hinge pin 4 is small because of the compact design of the extension 7 with its profiling 21, which is realized here by an insert part 20. The provision of a torsion spring 16 with two free ends 19 which are in engagement with the profiling 21 enables the radius for obtaining a defined holding force to be selected to be correspondingly smaller and therefore closer to the hinge pin.

It is obvious that instead of an insert part 20 the extension 7 can also be designed with the profiling 21, in which case the insert part 20 is then superfluous and the extension 7 together with its profiling defines the first and the second guiding arrangement by itself.

Figure 4:
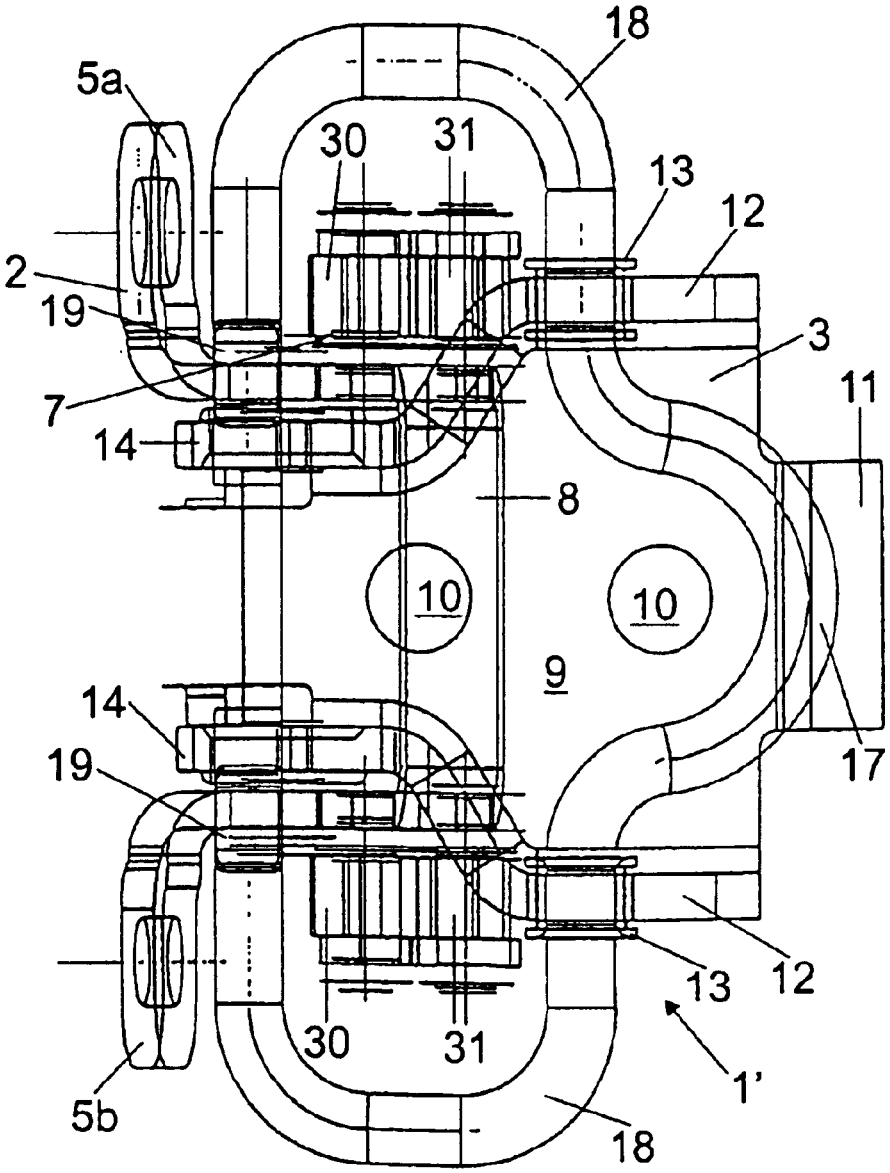
FIG. 4 shows a side view of a second preferred exemplary embodiment of a door hinge according to the invention with a view of the first, pillar-side hinge half.
Figure 6:
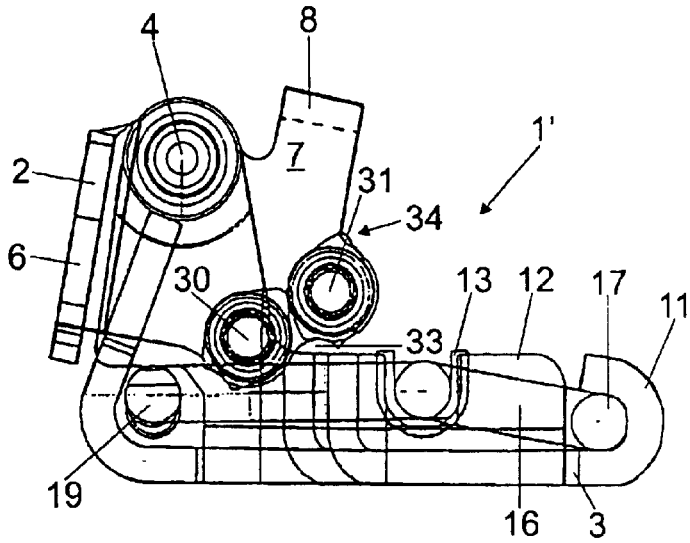
FIG. 6 shows an end view of the door hinge from FIGS. 4 and 5.
Figure 5:
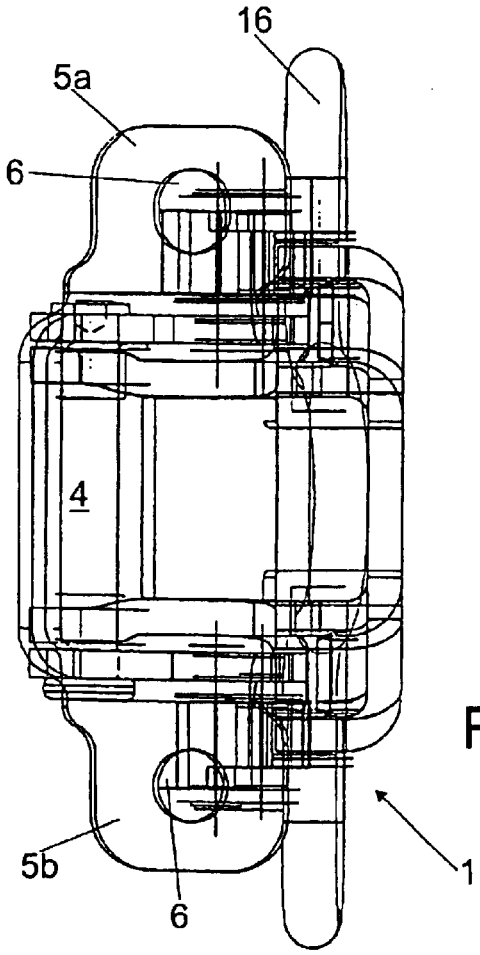
FIG. 5 shows a side view of the door hinge from FIG. 4 with a view of the second door-side hinge half.

The second door hinge 1', which is illustrated in FIG. 4 to 6, is essentially comparable to the door hinge 1, and so the same reference numbers refer to the same parts and are no longer introduced individually.

The door hinge 1' likewise comprises a first hinge half 2 and a second hinge half 3, which are basically configured in the same manner as in the previous exemplary embodiment, and which are likewise designed with a torsion spring 16.

The extensions 7 of the first hinge half 2 do not have any insert parts, but mountings for two latching rollers 30, 31 are in each case formed on their outwardly directed flat sides which are orientated essentially parallel to the free end 19, which does not have a running roller here, or to the hinge pin 4. It can be seen that the extension 7 also has a profiling 21, but this is not intended to come into engagement with the free end 19 of the torsion spring 16, but rather is defined on the basis of the position of the latching rollers 30, 31. During pivoting of the two hinge halves 2, 3 relative to each other for the purpose of opening a vehicle door, a region of the leg 18, which region is situated somewhat above the end side of the free end 19, comes to bear against an inwardly directed recess 30*a* in a projection of the latching roller 30, and during the further opening movement of the door hinge 1' is guided by the rotational movement of the latching roller 30 about its own axis by the recess 30*a*, the radius of the recess 30*a* being matched to the radius of the leg 18 of the torsion spring 16. In the region 33, which defines a first latching position, the torsion spring 16 is transferred from the first latching roller 30 to the second latching roller 31 which likewise has a recess 31*a* of the above-described type in order in turn to be able to pass with further guidance into a second latching region 34 close to the end stop. During the closing movement of the motor vehicle door the same stations are passed through in the same sequence.

As can be seen in particular in FIG. 4, the two extensions 7 are equipped with is latching rollers 30, 31, as a result of which the same latching and guiding movement takes place on the two legs 18 of the torsion spring 16. The extension 7 therefore defines, with the latching rollers 30, 31, a guiding arrangement for a free end 19 of the spring element designed as a torsion spring 16, a first and a second guiding arrangement being provided in each case in the door hinge 1'. This makes it possible to configure the door hinge 1' to be small in construction, since the required holding forces are applied by two spring elements 16 and therefore the radii which are required for defining latching positions and which are to be overcome, can be configured to be correspondingly smaller.

The invention has been described above referring to two preferred exemplary embodiments, in which the first and the second free ends 19 are both ends of the same spring element 16. However, it is possible to provide two torsion springs instead of a single torsion spring, each of which engages with a free end of the associated guiding arrangement 7, 20 or 7, 30, 31.

What is claimed is:

1. A vehicle door hinge for a vehicle door, comprising a first hinge half and a second hinge half, each of the first hinge half and the second hinge half capable of being fastened to one of a door and a door pillar, a hinge pin connecting the first hinge half and the second hinge half pivotably with respect to each other, a first guiding arrangement and a second guiding arrangement formed on one of the first hinge half and the second hinge half, a first spring element having a first free end, the first spring element being secured on the other of the first hinge half and the second hinge half, and a second free end, one of a second spring element and said first spring element having the second free end, wherein said first free end is prestressed against the first guiding arrangement and said second free end is prestressed against the second guiding arrangement for securing at least one holding position for the vehicle door hinge, and wherein the first free end and the second free end are in each case arranged in a mirror-inverted manner with respect to each other on said other of the first hinge half and the second hinge half and wherein a distal tip of the first free end and a distal tip of the second free end face each other.

2. The vehicle door hinge as claimed in claim 1, wherein the first guiding arrangement and the second guiding arrangement are designed in a mirror-inverted manner with respect to each other.

3. The vehicle door hinge as claimed in claim 1, wherein the first spring element has the second free end.

4. The vehicle door hinge as claimed in claim 1, wherein the first free end of the first spring element comprises a leg, and wherein the leg is supported in a sleeve arranged in said other of the first hinge half and the second hinge half.

5. The vehicle door hinge as claimed in claim 1, further comprising a clamping unit formed in said other of the first hinge half and the second hinge half for securing the first spring element.

6. The vehicle door hinge as claimed in claim 1, wherein the first spring element protrudes over said other of the first hinge half and the second hinge half forming a bow on a side facing away from a fastening surface of said other of the first hinge half and the second hinge half.

7. The vehicle door hinge as claimed in claim 3, wherein the first spring element includes a first leg and a second leg respectively assigned to the first end and to the second end, and wherein the first spring element and the legs together are in a three-leaf clover leaf configuration.

8. The vehicle door hinge as claimed in claim 1, wherein the first hinge half includes two joints arranged between two other joints of the second hinge half.

9. The vehicle door hinge as claimed in claim 1, wherein the first guiding arrangement and the second guiding arrangement define similar latching positions for the vehicle door hinge.

10. The vehicle door hinge as claimed in claim 1, wherein at least one of a maximum opening angle and a closing position of the vehicle door hinge is defined by a projection on one of the first hinge half and the second hinge half, said projection defining a stop.

11. The vehicle door hinge as claimed in claim 1, wherein at least one of the first guiding arrangement and second guiding arrangement is designed as a latching arrangement including at least one latching roller which defines a latching holding position for the respective first end and second end of the first spring element.

12. The vehicle door hinge as claimed in claim 1, wherein at least one of the first guiding arrangement and second guiding arrangement has a profiled contour having at least one depression defining a latching position for a respective one of the first end and the second end.

13. The vehicle door hinge as claimed in claim 12, wherein the respective one of the first end and the second end bears a running roller arranged to roll against the profiled contour.

14. The vehicle door hinge as claimed in claim 12, wherein the profiled contour of the at least one guiding arrangement is formed by an insert part inserted into said one of the first hinge half and the second hinge half.

15. The vehicle door hinge as claimed in claim 14, wherein the insert part has a hardened contact surface defining at least one latching position.

16. The vehicle door hinge as claimed in claim 14, wherein the insert part is clamped to said one of the first hinge half and the second hinge half.

17. The vehicle door hinge as claimed in claim 1, wherein the first free end and the second free end are both arranged on a same side of a fastening part of said other of the first hinge half and the second hinge half.

18. The vehicle door hinge as claimed in claim 1, wherein the first hinge half and the second hinge half each comprise two joints, and wherein mutually averted joint surfaces of the two joints of one of the first hinge half and the second hinge half are surrounded by mutually facing joint surfaces of the two joints of the other of the first hinge half and the second hinge half.

19. The vehicle door hinge as claimed in claim 1, wherein at least one holding position for the vehicle door hinge corresponds to a partially open position of the vehicle door.

20. A vehicle door hinge for a vehicle door, comprising a first hinge half and a second hinge half, each of the first hinge half and the second hinge half capable of being fastened to one of a door and a door pillar, a hinge pin connecting the first hinge half and the second hinge half pivotably with respect to each other, a first guiding arrangement and a second guiding arrangement formed on one of the first hinge half and the second hinge half, a first spring element having a first free end, the first spring element being secured on the other of the first hinge half and the second hinge half, and a second free end, one of a second spring element and said first spring element having the second free end, wherein said first free end is prestressed against the first guiding arrangement and said second free end is prestressed against the second guiding arrangement for securing at least one holding position for the vehicle door hinge, and wherein the first free end and the second free end are in each case arranged in a mirror-inverted manner with respect to each other on said other of the first hinge half and the second hinge half, wherein the first guiding arrangement includes a first cam profile and the second guiding arrangement includes a second cam profile, the first and second cam profiles oriented substantially radially with respect to an articulation axis of the hinge.

21. A hinge assembly for a swinging door of a motor vehicle with a built-in door stop, comprising:

a first hinge half having a first part and a second part arranged substantially perpendicular to said first part, the first part including holes for being fixed to one of a vehicle door and a vehicle door pillar, the second part including a vertical bore for receiving a hinge pin about which the hinge pivots, a second hinge half having at least one hole for being fixed to the other of a vehicle door and a vehicle door pillar, further comprising two approximately flat zones, each of said flat zones being provided with a vertical bore for receiving the hinge pin and each of said flat zones comprising a notched cam, a first and a second pressing roller intended to be kept in contact with a corresponding cam of said second hinge half, a spring held in said first hinge part and having two vertical legs which are vertically aligned and inserted in said rollers and working mainly in bending so as to cause said rollers to exert pressure on said cams, said pin articulating the first hinge half and the second hinge half.

22. The hinge assembly as claimed in claim 21, wherein said rollers have an external surface of mainly circular shape, and wherein said cams comprise latching positions corresponding to the shape of the external surface of said rollers.

23. The hinge assembly as claimed in claim 21, wherein said spring comprises, in addition to the two vertical legs, two horizontal legs connected by a third, approximately vertical leg.

24. The hinge assembly as claimed in claim 23, wherein said first hinge half comprises a groove intended to receive the third approximately vertical leg, and wherein said first hinge half comprises two sleeves for receiving portions of said two horizontal legs, the third approximately vertical leg and the two horizontal legs defining a spring plane from which said two vertical legs are bent away.

25. A vehicle door hinge for coupling a vehicle door to a vehicle, comprising:

a first hinge half;

a second hinge half;

a hinge pin pivotably connecting said first hinge half and said second hinge half and defining an articulation axis; and a door stop arrangement, said door stop arrangement comprising a first guiding arrangement and a second guiding arrangement provided radially with respect to said articulation axis on said second hinge half; and a torsion spring held on said first hinge half having a first free torsion spring end prestressed against said first guiding arrangement and a second free torsion spring end prestressed against said second guiding arrangement, wherein the first free torsion spring end and the second free torsion spring end each comprise a frontal end, said frontal ends facing each other.

26. The vehicle door hinge according to claim 25, wherein the first free torsion spring end and the second free torsion spring end are mainly arranged in a single load axis that is substantially parallel to said articulation axis.

* * * * *